US010266233B2

(12) United States Patent
Dishon

(10) Patent No.: US 10,266,233 B2
(45) Date of Patent: Apr. 23, 2019

(54) RAMP ASSEMBLY SYSTEMS AND METHODS OF USE

(71) Applicant: Robert M. Dishon, Kalispell, MT (US)

(72) Inventor: Robert M. Dishon, Kalispell, MT (US)

( * ) Notice: Subject to any disclaimer, the term of this patent is extended or adjusted under 35 U.S.C. 154(b) by 9 days.

(21) Appl. No.: 15/472,141

(22) Filed: Mar. 28, 2017

(65) Prior Publication Data

US 2017/0283010 A1 Oct. 5, 2017

Related U.S. Application Data

(60) Provisional application No. 62/315,232, filed on Mar. 30, 2016.

(51) Int. Cl.
*B63B 27/14* (2006.01)
*E01D 15/12* (2006.01)

(52) U.S. Cl.
CPC ..... *B63B 27/143* (2013.01); *E01D 15/124* (2013.01); *B63B 2027/141* (2013.01)

(58) Field of Classification Search
CPC .. B65G 69/2876; B65G 69/30; B63B 27/143; B63B 2027/141; E01D 15/124; E01D 18/00
See application file for complete search history.

(56) References Cited

U.S. PATENT DOCUMENTS 3,411,169 A * 11/1968 Guerke ..... B63B 27/143 114/260
4,131,209 A * 12/1978 Manning ..... A61G 3/061 105/433
4,647,270 A * 3/1987 Maloney ..... B60P 1/43 296/61
5,085,165 A * 2/1992 Reed ..... B63B 27/14 114/362
5,467,855 A * 11/1995 Sorensen ..... B60P 1/431 193/5
5,472,306 A * 12/1995 Stoll ..... B60P 1/431 414/537
5,636,399 A * 6/1997 Tremblay ..... A61G 3/061 14/71.1
5,832,555 A * 11/1998 Saucier ..... A61G 3/061 14/71.1
7,228,582 B1 * 6/2007 Jones ..... B63B 27/143 14/69.5
7,237,294 B2 * 7/2007 Lensing ..... B65G 69/30 14/69.5
7,478,449 B2 * 1/2009 Williams ..... B65G 69/30 14/69.5
2005/0081775 A1 * 4/2005 Blank ..... B63B 27/143 114/362

(Continued)

*Primary Examiner* — Abigail A Risic
(74) *Attorney, Agent, or Firm* — Wells St. John P.S.

(57) ABSTRACT

According to one aspect, a vessel ramp assembly system includes a ramp assembly configured to assist with ingress and egress of an individual with respect to the vessel, a deployment system configured to move the ramp assembly between a stowed position with respect to the vessel and a deployed position with respect to the vessel, and a positioning system configured to move the ramp assembly to move a first end of the ramp assembly with respect to a deck of the vessel and provide a second end of the ramp assembly at an appropriate position where the individual may use the ramp assembly for the ingress and egress with respect to the vessel.

18 Claims, 7 Drawing Sheets

(56) References Cited

U.S. PATENT DOCUMENTS

| | | | | |
|---|---|---|---|---|
| 2006/0081169 | A1* | 4/2006 | Waldock | B63B 1/121<br>114/362 |
| 2007/0044702 | A1* | 3/2007 | Waldock | B63B 1/12<br>114/362 |
| 2007/0163484 | A1* | 7/2007 | Eng | B63B 27/143<br>114/362 |
| 2008/0202405 | A1* | 8/2008 | Kern | B63B 23/30<br>114/259 |
| 2011/0017119 | A1* | 1/2011 | Muller | B63B 23/32<br>114/284 |
| 2013/0255012 | A1* | 10/2013 | Prins | B63B 27/14<br>14/71.1 |

* cited by examiner

RAMP ASSEMBLY SYSTEMS AND METHODS OF USE

RELATED PATENT DATA

This application claims the benefit of U.S. Provisional Patent Application Ser. No. 62/315,232, filed Mar. 30, 2016, entitled "Ramp Assembly Systems and Methods of Use", the disclosure of which is incorporated herein by reference.

TECHNICAL FIELD

This disclosure relates to ramp assembly systems and methods of use.

BACKGROUND OF THE DISCLOSURE

The present disclosure is directed to ramp assembly systems, components thereof, and methods of use. In some embodiments, the ramp assembly systems are used to facilitate ingress and egress with respect to a vessel, such as a pontoon boat.

In some arrangements, a ramp assembly of the system may be deployed during use upon a vessel to provide a safe and secure system for people to board and un-board the vessel with respect to various shorelines, docks, etc. and to additionally assist swimmers wishing to enter the vessel from the water. The example systems and methods described below may also be used to assist with the ingress and egress of people using wheelchairs with respect to the vessel.

BRIEF DESCRIPTION OF THE DRAWINGS

Example embodiments of the disclosure are described below with reference to the accompanying drawings.

DETAILED DESCRIPTION OF THE DISCLOSURE

This disclosure is submitted in furtherance of the constitutional purposes of the U.S. Patent Laws "to promote the progress of science and useful arts" (Article 1, Section 8).

According to some example embodiments of the disclosure, ramp assembly systems and methods of use are described. The ramp assembly systems may be utilized in various applications, for example, upon a vessel to assist people with ingress and egress relative to the vessel. A ramp assembly of the system may be moved between a deployed position for use to assist with ingress and egress with respect to the vessel and a stowed position when not in use.

An operator's controller for controlling operations of the ramp assembly systems may be installed adjacent to the steering and propulsion controls of the vessel and operated by the operator of the vessel in some typical implementations. Example embodiments of the disclosure allow for safe access to the vessel without the need to jump on or off with respect to differing shorelines and the ability for the elderly and handicapped to safely board or exit the vessel. The present disclosure describes example embodiments of ramp assembly systems and methods of operation and other embodiments of the apparatus and methods are possible.

Figure 1:
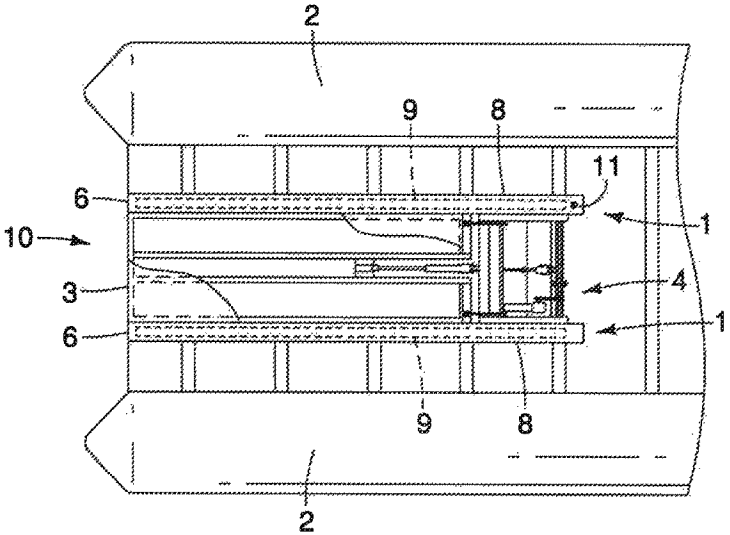
FIG. 1 is an illustrative representation of a ramp assembly system according to one embodiment of the disclosure mounted below the deck of a vessel in a stowed position.
Figure 2:
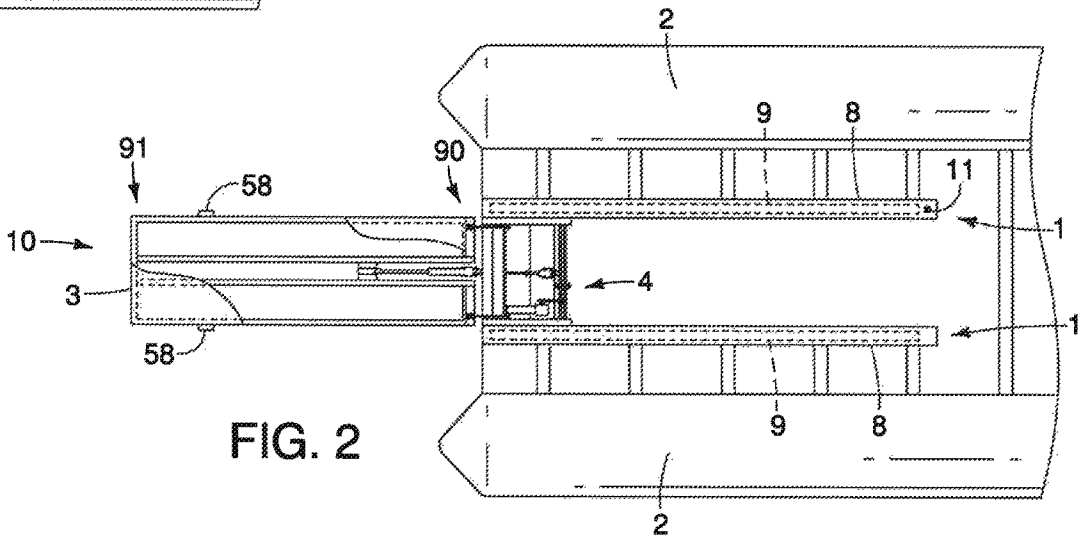
FIG. 2 is an illustrative representation of a ramp assembly system according to one embodiment mounted below the deck of a vessel in a deployed position.

Referring to FIGS. 1 and 2, an example embodiment of the ramp assembly system 10 is shown mounted to a vessel 2 such as a pontoon boat. The ramp assembly system 10 is shown installed between pontoons of the vessel 2 at a location below the deck of vessel 2 in the illustrated implementation of system 10.

According to one embodiment, ramp assembly system 10 includes a support assembly 1, a ramp assembly 3, and a trolley assembly 4. As described below, ramp assembly 3 includes a deck which assists individuals with ingress and egress with respect to the vessel 2, including accommodation of individuals who utilize wheel chairs. FIG. 1 shows ramp assembly 3 in a stowed position when ingress or egress is not needed, for example during side docking, travel, etc., while FIG. 2 shows the ramp assembly in a deployed position to assist with ingress or egress. As shown in FIG. 2, a proximal end 90 of ramp assembly 3 is adjacent to vessel 2 and a distal end 91 of assembly 3 is spaced from vessel 2 when assembly 3 is in the deployed position.

The trolley assembly 4 is coupled between the support assembly 1 and ramp assembly 3 and includes in one example embodiment a deployment system which is configured to move the ramp assembly 3 between the stowed position with respect to the vessel 2 shown in FIG. 1 and the deployed position with respect to the vessel 2 shown in FIG. 2. In addition, the illustrated embodiment of trolley assembly 4 also includes a positioning system which is configured to move a first end of the ramp assembly 3 with respect to the deck of the vessel 2 (for example to elevationally align the proximal end 90 of a deployed ramp assembly 3 with a deck of vessel 2 or lower proximal end 90 below the deck for stowage) and move a second end of the ramp assembly 3 to an appropriate position where individuals may use the ramp assembly 3 for ingress and egress with respect to the vessel 2. Additional details regarding the operation of the trolley assembly including the deployment system and positioning system are discussed in detail in example embodiments below.

The ramp assembly 3 is located below the deck of the vessel 2 when the ramp assembly 3 is in stowed position in the illustrated implementation. In one embodiment, support assembly 1 includes two parallel support tracks 8 which are affixed to the vessel 2 at locations beneath the deck of vessel 2. The tracks 8 are elongated C-channels in the illustrated arrangement and are made of a suitable material, such as aluminum or steel, with the elongated openings of the tracks facing one another. In one more specific example, tracks 8 are 6061 T6 aluminum channels with a ¼" flange.

The upper elongated portions of the C-channel tracks 8 are attached to the vessel 2 so the tracks 8 do not move relative to the vessel 2. A gear rack 9 is attached to an upper surface of the upper elongated portion of each track 8, and a mating spur gear of the trolley assembly 4 described below engages the gear rack 9, and the spur gears are driven to move the trolley assembly 4 and ramp assembly 3 relative to the support assembly 1 and the vessel 2 between the stowed and deployed positions as discussed in further detail below. In one embodiment, each of the gear racks 9 is a part number 6NSR16X1/2 available from Browning.

In addition, lower elongated portions of the C-channel tracks 8 are configured to support idler wheels 36, 39 of the trolley assembly 4 (shown in FIG. 3) during movement between the stowed and deployed positions of the ramp assembly 3 as discussed below. The lower elongated portions of the C-channels also receive and support idler wheels 58 of the ramp assembly 3 in the stowed position. Forward ends of the tracks 8 include a stop plate 6 which operates to stop the trolley assembly 4 during movement from the stowed to the deployed positions.

Figure 3:
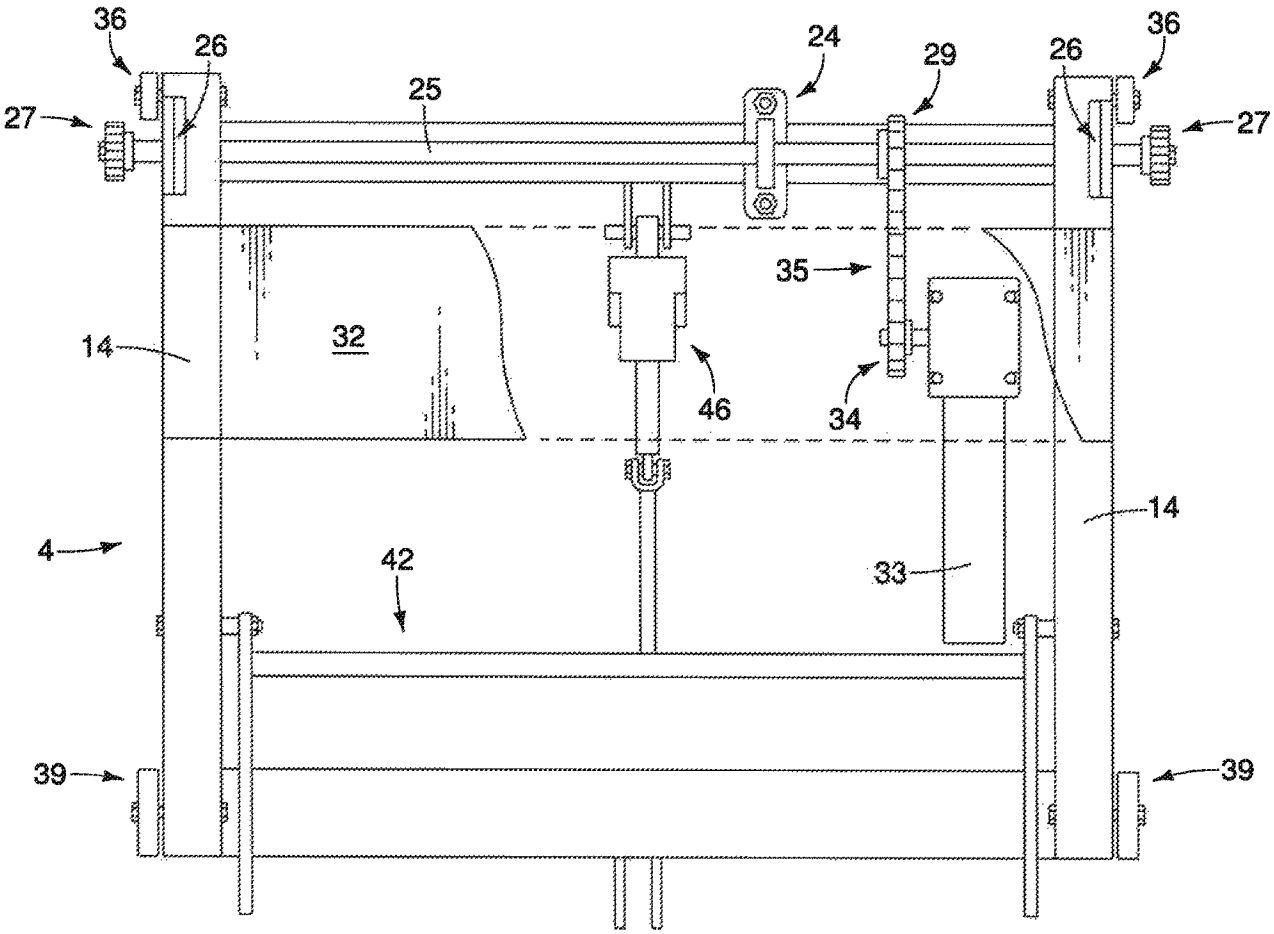
FIG. 3 is an illustrative representation of a trolley assembly according to one embodiment.

With reference to the example embodiment of FIG. 3, trolley assembly 4 includes a trolley frame 14 coupled with plural idler wheels 36, 39 and spur gears 27 and which are configured to move along the tracks 8 of support assembly 1 to move the ramp assembly 3 between the stowed and deployed positions as mentioned above. Idler wheels 36 are received within the elongated openings of the C-channel tracks 8 and are supported by the lower elongated portions of the C-channel tracks 8 at different positions between the stowed and deployed positions of the trolley assembly 4. Spur gears 27 mate with the gear racks 9 on the upper surfaces of the upper elongated portions of the C-channel tracks 8. In one embodiment, spur gears 27 may each be implemented using part NB20B available from Boston Gear and idler wheels 36 are 2" rubber caster wheels and idler wheels 39 are 3" steel caster wheels.

Deployment of the ramp assembly 3 is controlled by the operator by activating a drive motor 33 of the trolley assembly 4. In one embodiment, drive motor 33 may be implemented using a 65RPM Angle Drive Motor part number 5LAF8 available from Dayton. A chain 35 is coupled with a sprocket 34 of the drive motor 33 and a sprocket of a drive shaft 25. Drive shaft 25 is supported by block bearings 24, 26.

Movement of the trolley assembly 4 is achieved when power is transferred from the drive motor 33 to drive shaft 25 via chain 35 and sprockets 29, 34 in the illustrated embodiment. The drive shaft 25 is coupled with spur gears 27 of the trolley 4 which mate with the gear racks 8 of the tracks 8 which are mounted to the vessel 2 as mentioned above. Accordingly, the application of a rotational force to drive shaft 25 operates to rotate spur gears 27 which mate with the gear racks 8 of the tracks 8. Rotation of the sprocket 34 in opposition directions in response to commands from the operator's controller moves the trolley and ramp assemblies 3, 4 between the stowed and deployed positions and vice versa. In one embodiment, sprockets 29, 34 are 12-Tooth Sprockets for chain 35 which is implemented as a #40 roller chain. The drive motor 33, drive shaft 25, spur gears 27 and associated components thereof are one example embodiment of the deployment system mentioned above and other embodiments of the deployment system are possible in other arrangements.

Upon deployment of the trolley assembly 4 and ramp assembly 3, movement of the trolley assembly 4 is stopped when deployment stop tabs 5 (see FIG. 5) of trolley assembly 4 contact the deployment stop plates 6 of tracks 8 of FIGS. 1 and 2. In one embodiment, the positioning system may operate to move the ramp assembly 3 once the deployment system has fully deployed the ramp assembly 3 to the deployed position.

For example, in one embodiment, one of tracks 8 includes a full deployment tab (not shown) adjacent to the stop plate 6 at the end of support assembly 1 where the ramp system 3 is deployed. The trolley assembly 4 may include a full deployment switch 50*a* (see FIG. 5) which is mounted upon frame 14 at a location which engages the full deployment tab in track 8 upon full deployment of the trolley assembly 4. The triggering of the full deployment limit switch 50*a* corresponding to the deployment of the trolley assembly 4 and ramp assembly 3 allows activation of a level lift assembly discussed below to move ramp assembly 3 once it has been fully deployed.

Figure 4:
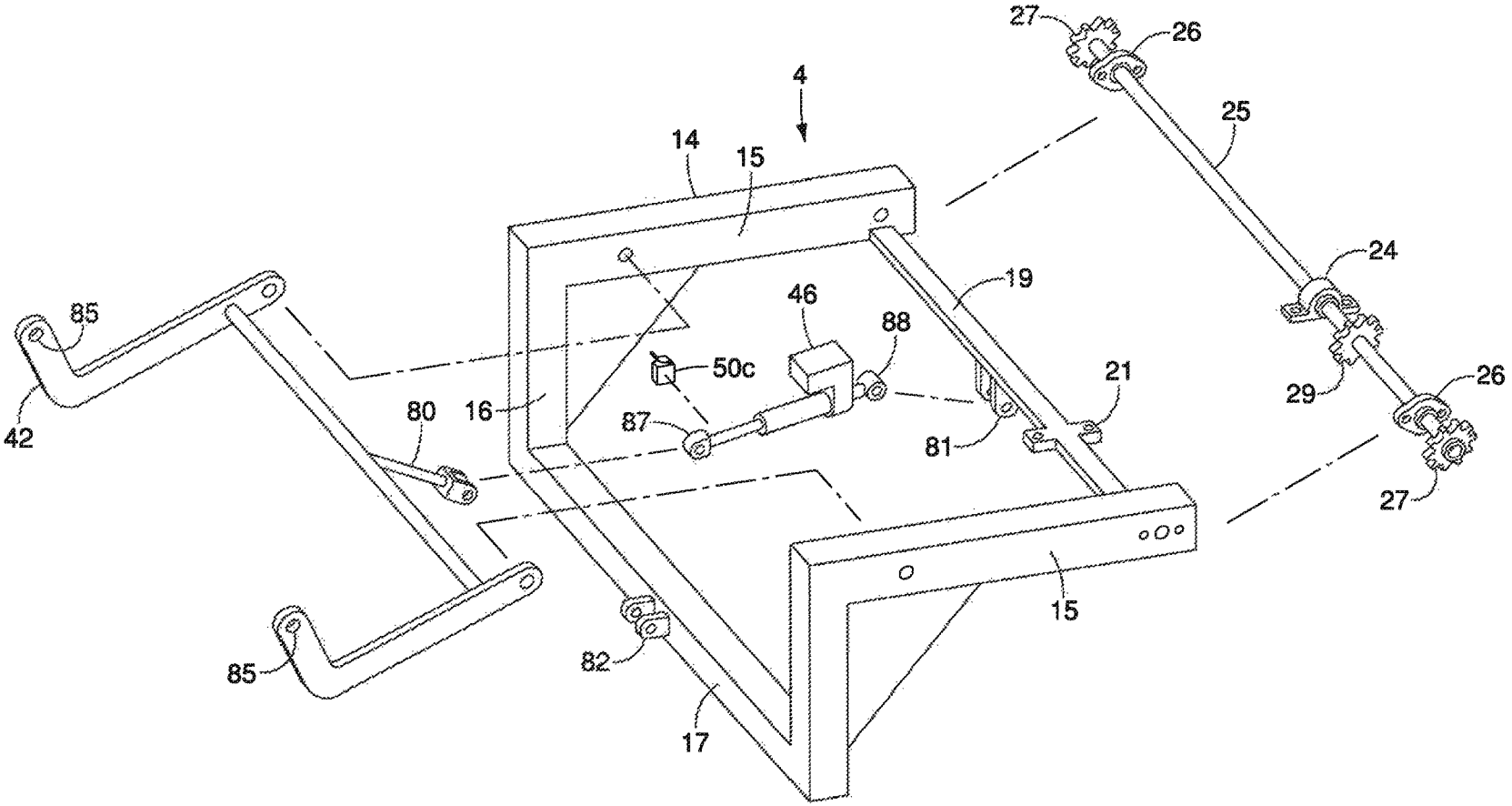
FIG. 4 is an exploded view of a trolley assembly and a level lift assembly according to one embodiment.

Referring to FIG. 4, one embodiment of a level lift assembly is shown including a level lift mechanism 42 and an actuator 46. The level lift mechanism 42 of the trolley assembly 4 is utilized to raise and lower the proximal end 90 of the ramp assembly 3 adjacent to the deck of the vessel 2 when the trolley assembly 4 and ramp assembly 3 are in the deployed positions. Level lift mechanism 42 is rotatably attached to the frame 14 of trolley assembly 4 using appropriate hardware (not shown), such as a mounting bolt, nut and jam nut in one embodiment. A driver end 87 of level lift actuator 46 is coupled with an extension 80 of the level lift mechanism 42 using a pin. A base end 88 of actuator 46 is coupled with tabs 81 of the trolley frame 14 via another pin. As discussed below, actuator 46 is configured to move ramp assembly 3 to align the proximal end 90 of the ramp assembly 3 in the deployed position with a deck of the vessel 2.

In one embodiment, frame 14 includes side members 15, frame extensions 16, and a front connector 17 which are each implemented using 2"×3" 6061 T6 Al tubing with a ⅛" wall. The illustrated frame 14 additionally includes a rear connector 19 which is 1"×2" 6061 T6 Al tubing with a ⅛" wall. Actuator 46 is implemented using a Linear Actuator with part number LACT6-500A available from Concentric in one implementation. A gear drive shaft center bearing block mount 21 is also shown which is attached to and supports block bearing 24.

Figure 5:
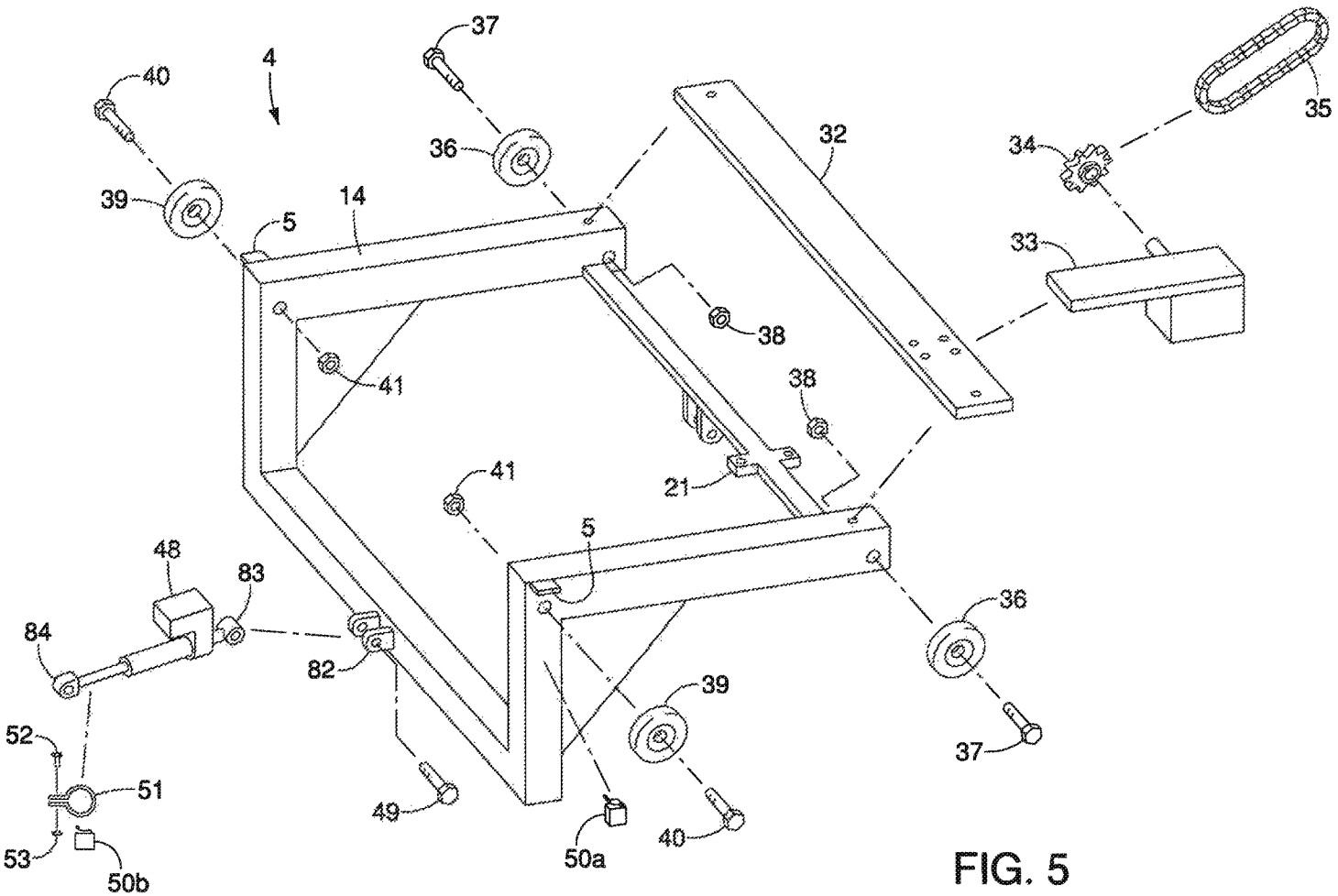
FIG. 5 is an exploded view of a trolley assembly and a ramp lift assembly according to one embodiment.

Referring to FIG. 5, additional details of an embodiment of the trolley assembly 4 are shown. Drive motor 33 is affixed to a mounting plate 32 which is affixed to trolley frame 14. Idler wheels 36 are attached to trolley frame 14 using mounting bolts 37 and respective nuts 38 and idler wheels 39 are attached to trolley frame 14 using mounting bolts 40 and respective nuts 41.

Figure 6:
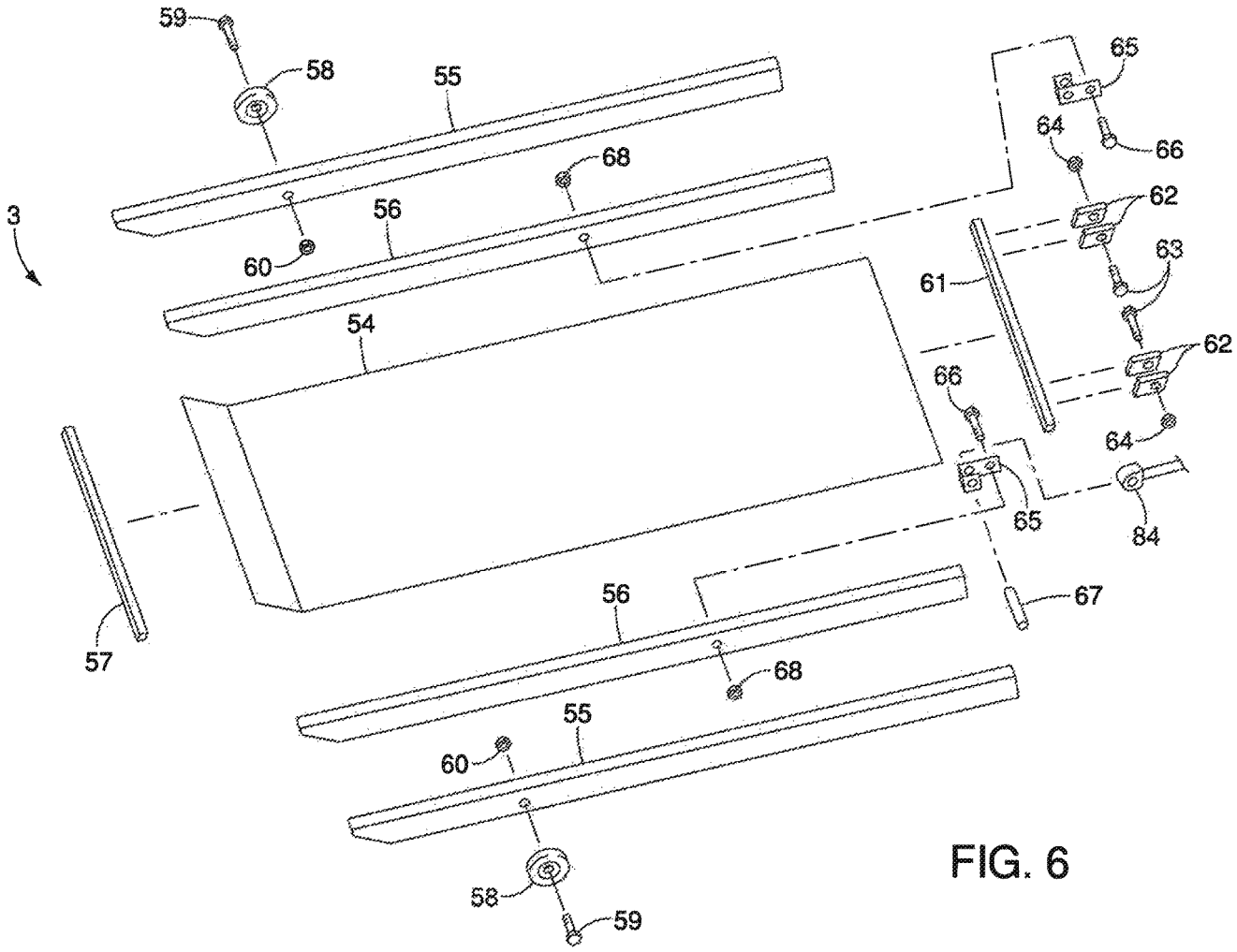
FIG. 6 is an exploded view of a ramp assembly according to one embodiment.

FIG. 5 additionally shows a ramp lift assembly in the form of an actuator 48 in one embodiment. A base end 83 of actuator 48 is rotatably coupled with mounting bracket 82 of the frame 14 using a pin 49 and the driver end 84 of actuator 48 is coupled with ramp assembly 3 (for example as shown in FIG. 6). Actuator 48 is implemented using a Linear Actuator with part number LACT12-1000B available from Concentric in one implementation. As discussed below, actuator 48 is configured to move a distal end of the ramp assembly 3 provided in the deployed position either upwards of downwards in response to the operator's controller.

Referring to FIG. 6, details of an example ramp assembly 3 are shown according to one embodiment. The illustrated assembly 3 includes a ramp assembly deck 54, a plurality of outside rails 55, a plurality of inside rails 56, a front rail 57 and a rear support rail 61. Idler wheels 58 are coupled with outside rails 55 using appropriate bolts 59 and nuts 60.

Plural mounting brackets 62 are attached to the rear support rail 61 and further rotatably coupled with the parallel extensions 85 of level lift mechanism 42 using bolts 63 and nuts 64. A mounting bracket 65 is attached to each inside rail 56 using a bolt 66 and the mounting brackets 65 of the rails 56 are further rotatably attached to the driver end 84 of actuator 48 using a pin 67. Mounting brackets 65 are positioned to couple the driver end of actuator 48 with ramp assembly 3 at a location between the proximal and distal ends 90, 91 of the ramp assembly 3 in one embodiment.

In one embodiment of ramp assembly 3, deck 54 is implemented as a H3003 3/16" Aluminum Deck Bright Sheet with a dimension of 32"×60", inside rails 55, 56 are 1"×2" 6061 T6 Al tubing with a ⅛" wall, front rail is 1"×1" 6061 T6 Al tubing with a ⅛" wall, rear support rail 61 is 1.25"×1.25" 6061 T6 Al tubing with a ⅛" wall, and idler wheels 58 are 2" steel caster wheels.

Figure 7A:
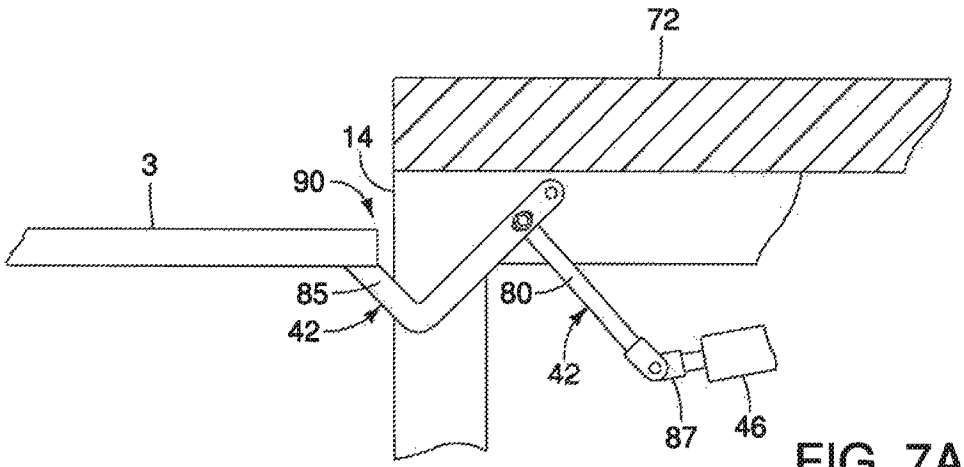
FIGS. 7A-7B are illustrative representations of a level lift assembly according to one embodiment in first and second positions.
Figure 7B:
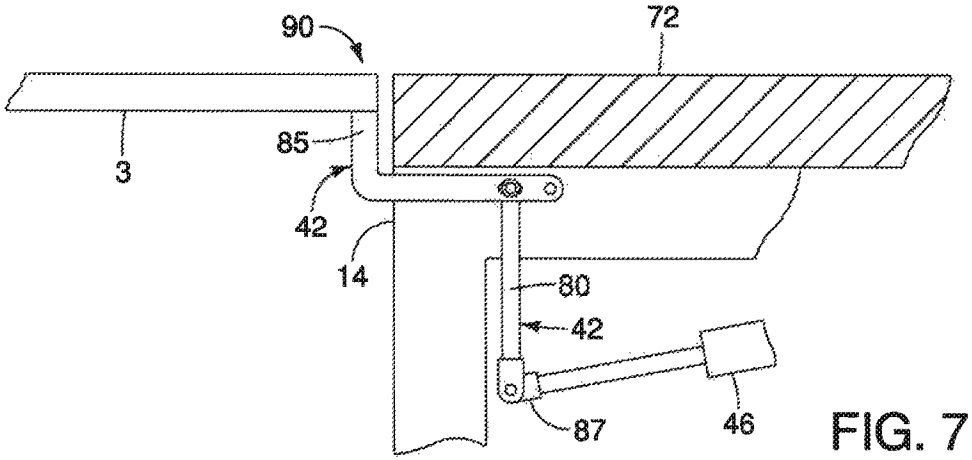

Referring to FIGS. 7A and 7B, level lift operations with respect to the ramp assembly 3 are illustrated according to one embodiment. Following movement of the ramp assembly 3 and trolley assembly 4 to the deployed position shown in FIG. 7A, an operator may control the level lift actuator 46 to extend the driver end 87 approximately 6 inches from the position shown in FIG. 7A to the position shown in FIG. 7B. The extension of the driver end 87 of level lift actuator 46 rotates the level lift mechanism 42 which in turn raises the proximal end 90 of ramp assembly 3 to a position which is relatively elevationally close to and elevationally aligned with the upper surface of deck 72 of vessel 2 in one embodiment.

The ramp assembly 3 is at least substantially elevationally aligned or level with the deck 72 of vessel 2 in FIG. 7B and the ramp assembly 3 may be utilized to board and de-board the vessel 2 with the level lift mechanism 42 and proximal end 90 of ramp assembly 3 positioned as shown in FIG. 7B. Accordingly, in one embodiment, actuator 46 moves proximal end 90 of ramp assembly 3 from a position which is elevationally below deck 72 of vessel 2 to a second position where the ramp assembly 3 is at least substantially elevationally aligned or level with deck 72 of vessel 2. Thereafter, the driver end 87 of actuator 46 may be retracted which returns the ramp assembly 3 to the position shown in FIG. 7A and which permits the trolley assembly 4 and ramp assembly 3 to be moved to the stowed position.

Figure 8A:
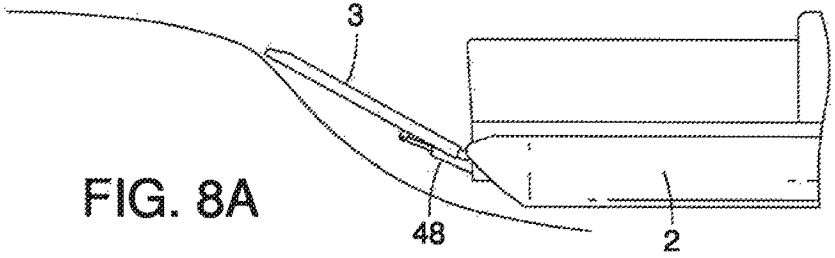
FIGS. 8A-8C are illustrative representation of a ramp assembly deployed at various angles in one embodiment with respect to a deck of a vessel.
Figure 8B:
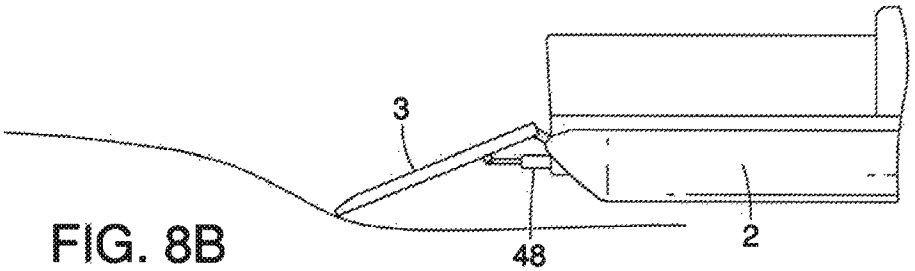
Figure 8C:
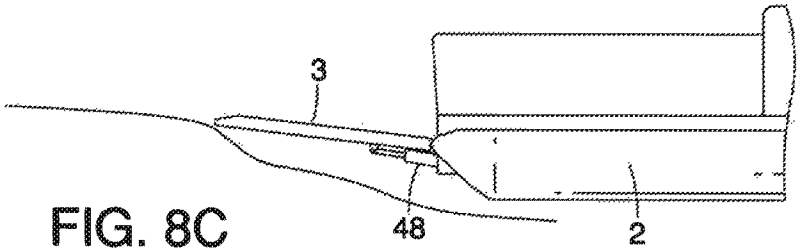

Referring to FIGS. 8A-8C, lift operations of ramp assembly 3 are described and different orientations of the ramp assembly 3 with respect to different shorelines are illustrated according to one embodiment. In particular, ingress and egress of vessel 2 may be implemented using ramp assembly 3 with different shorelines including high bank and low banks.

In particular, following deployment of the ramp assembly 3 to the deployed position and level operations discussed above, the operator may control the ramp assembly lift actuator 48 of the positioning system to extend driver end 84 outwardly from base end 83 which operates to raise distal end 91 of the ramp assembly 3 to a desired position with respect to the shoreline. In addition, the operator may control the ramp assembly lift actuator 48 of the positioning system to retract driver end 84 inwardly towards base end 83 which operates to lower the distal end 91 of ramp assembly 3 to a desired position with respect to the shoreline, the surface of the water, etc. The movement of the driver end 84 of the actuator 48 operates to selectively move the distal end 91 of the ramp assembly 3 to positions which may be elevationally above the deck of the vessel 2, horizontal with deck or elevationally below the deck in one embodiment.

As shown, full extension of the driver end 84 allows ingress and egress with respect to a high bank shoreline of FIG. 8A (e.g., 0-25 degrees above horizontal), full retraction of the driver end 84 allows ingress and egress with respect to a low bank shoreline of FIG. 8B (e.g., 0-33 degrees below horizontal), and midway positioning of the distal end 91 of ramp assembly 3 allows at least substantially horizontal positioning of ramp assembly 3 for horizontal ingress and egress with respect to a shoreline.

In one more specific embodiment, the operator first momentarily depresses a ramp assembly lift limit over-ride switch while simultaneously selecting the direction of travel of distal end 91 upwards or downwards with a ramp assembly control switch. The lowered and horizontal positions of ramp assembly 3 may also assist swimmers who lack the ability to use a ladder to re-enter the vessel 2 from the water.

The level lift mechanism 42, level lift actuator 46 and ramp assembly lift actuator 48 are one example embodiment of the positioning system mentioned above and other embodiments of the positioning system are possible in other arrangements.

When the ramp assembly 3 is to be stowed, the ramp assembly 3 is moved to a substantially horizontal position using actuator 48. A ramp assembly lift limit switch 50*b* (see FIG. 5) is positioned at the driver end 84 of actuator 48 using a bolt 52 and nut 53, and switch 50*b* interrupts power to the actuator 48 and stops the movement of the ramp assembly 3 when the ramp assembly 3 is at the correct height for retraction and stowage. Power may be restored to the actuator 48 via the operator's controller, for example when the ramp assembly 3 is deployed at a subsequent moment in time.

Thereafter, the ramp assembly level lift mechanism 42 is then rotated downwardly by retracting the driver end 87 of level lift actuator 46. A level lift limit switch 50*c* (see FIG. 4) is positioned adjacent to driver end 87 of actuator 46. Once the level lift actuator 46 has fully retracted and rotated the level lift mechanism 42 to the full down position of FIG. 7A, the level lift limit switch 50*c* is triggered which will allow activation of the trolley assembly drive motor 33 for stowage. The trolley assembly 4 is then retracted with the ramp assembly 3 for stowage until trolley assembly 4 contacts retract stop bolt 11 which is provided through one or both of tracks 8 as shown in FIGS. 1 and 2 and corresponds to the stowed position.

Switches 50*a*-50*c* described above are used to prevent improper movement of some of the components of the apparatus 10 at certain times which may otherwise damage the components. In one embodiment, when ramp assembly 3 reaches full deployment, switch 50*a* is used to activate a 30 amp relay in the operator's controller which supplies power to a control switch which permits operation of level lift actuator 46. When the level lift actuator 46 is extended (i.e., away from the full down position), switch 50*c* activates a 30 amp relay in the operator's controller to disable operation of the drive motor 33. Once the level lift actuator 46 is returned to the full down position, switch 50*c* restores power to operate the drive motor 33. Upon movement of the trolley assembly 4 away from the fully deployed position to retract the ramp assembly 3, switch 50*a* cuts power and disables the control switch for the level lift actuator 46.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended aspects appropriately interpreted in accordance with the doctrine of equivalents.

Further, aspects herein have been presented for guidance in construction and/or operation of illustrative embodiments of the disclosure. Applicant(s) hereof consider these described illustrative embodiments to also include, disclose and describe further inventive aspects in addition to those explicitly disclosed. For example, the additional inventive aspects may include less, more and/or alternative features than those described in the illustrative embodiments. In more specific examples, Applicants consider the disclosure to include, disclose and describe methods which include less, more and/or alternative steps than those methods explicitly disclosed as well as apparatus which includes less, more and/or alternative structure than the explicitly disclosed structure.

What is claimed is:

1. A vessel ramp assembly system comprising:

a ramp assembly configured to assist with ingress and egress of an individual with respect to a vessel;

a deployment system coupled with the ramp assembly and configured to move the ramp assembly between a stowed position with respect to the vessel and a deployed position with respect to the vessel;

a positioning system coupled with the ramp assembly and configured to move a first end of the ramp assembly with respect to a deck of the vessel and to provide a second end of the ramp assembly at an appropriate position where the individual may use the ramp assembly for the ingress and egress with respect to the vessel;

a support assembly configured to be attached to the vessel, and wherein the deployment system is movably coupled with the support assembly to move the ramp assembly between the stowed position and the deployed position;

wherein the deployment system includes a trolley assembly coupled with the ramp assembly and the support assembly, and wherein the trolley assembly of the deployment system is configured to move the ramp assembly between the stowed and deployed positions; and wherein the positioning system comprises a first actuator coupled with the trolley and configured to move the first end of the ramp assembly, and a second actuator coupled with the trolley and configured to move the second end of the ramp assembly upwards or downwards.

2. The system of claim 1 wherein the positioning system is configured to move the ramp assembly when the ramp assembly is located in the deployed position.

3. The system of claim 1 wherein the ramp assembly is located below the deck of the vessel in the stowed position.

4. The system of claim 1 wherein the first end of the ramp assembly is a proximal end which is adjacent to the vessel when the ramp assembly is in the deployed position and the second end of the ramp assembly is a distal end which is spaced from the vessel when the ramp assembly is in the deployed position.

5. The system of claim 1 wherein the trolley assembly comprises a motor configured to move the ramp assembly and the trolley assembly between the stowed and deployed positions.

6. The system of claim 1 wherein the positioning system is configured to move the second end of the ramp assembly upwards wherein the second end of the ramp assembly is elevationally above the deck of the vessel at a first moment in time and the positioning system is configured to move the second end of the ramp assembly downwards wherein the second end of the ramp assembly is elevationally below the deck of the vessel at a second moment in time.

7. A vessel ramp assembly system comprising:

a support assembly configured to be attached to a vessel;

a ramp assembly configured to assist with ingress and egress of an individual with respect to the vessel;

a trolley assembly coupled with the ramp assembly and the support assembly, and wherein the trolley assembly is moveable between a first position relative to the support assembly where the ramp assembly is stowed with respect to the vessel and a second position relative to the support assembly where the ramp assembly is deployed with respect to the vessel;

wherein the trolley assembly includes a level lift assembly coupled with the ramp assembly, wherein the level lift assembly is configured to move a first end of the ramp assembly relative to a deck of the vessel when the ramp assembly is deployed;

wherein the trolley assembly includes a ramp lift assembly coupled with the ramp assembly, wherein the ramp lift assembly is configured to move a second end of the ramp assembly upwards or downwards when the ramp assembly is deployed to provide the second end of the ramp assembly at an appropriate position where the individual may use the ramp assembly for the ingress and egress with respect to the vessel;

wherein the level lift assembly is configured to move the first end of the ramp assembly from a first position below a deck of the vessel to a second position which is at least substantially level with the deck of the vessel; and wherein the level lift assembly includes an actuator and a level lift mechanism coupled with a driver end of the actuator and the first end of the ramp assembly, and wherein extension of the driver end of the actuator rotates the level lift mechanism and raises the first end of the ramp assembly from the first position to the second position.

8. The system of claim 7 wherein the ramp lift assembly includes an actuator which is configured to move the second end of the ramp assembly upwards wherein the second end of the ramp assembly is elevationally above the deck of the vessel at a first moment in time and the actuator is configured to move the second end of the ramp assembly downwards wherein the second end of the ramp assembly is elevationally below the deck of the vessel at a second moment in time.

9. The system of claim 7 wherein the support assembly is configured to be attached to the vessel at a location below the deck of the vessel.

10. A vessel ramp assembly system comprising:

a ramp assembly configured to assist with ingress and egress of an individual with respect to a vessel;

a deployment system coupled with the ramp assembly and configured to move the ramp assembly between a stowed position with respect to the vessel and a deployed position with respect to the vessel;

a positioning system coupled with the ramp assembly and configured to move a first end of the ramp assembly with respect to a deck of the vessel and to provide a second end of the ramp assembly at an appropriate position where the individual may use the ramp assembly for the ingress and egress with respect to the vessel; and wherein the positioning system is configured to apply a first force to move the first end of the ramp assembly upwards or downwards with respect to the deck of the vessel and to apply a second force to move the second end of the ramp assembly upwards or downwards to provide the second end of the ramp assembly at the appropriate position.

11. The system of claim 10 wherein the positioning system comprises a first actuator configured to apply the first force and a second actuator configured to apply the second force.

12. The system of claim 11 wherein the deployment system includes a trolley assembly coupled with the ramp assembly and the first and second actuators, and wherein the trolley assembly is configured to move the ramp assembly between the stowed and deployed positions.

13. A vessel ramp assembly system comprising:

a ramp assembly configured to assist with ingress and egress of an individual with respect to a vessel;

a deployment system coupled with the ramp assembly and configured to move the ramp assembly between a stowed position with respect to the vessel and a deployed position with respect to the vessel;

a positioning system coupled with the ramp assembly and configured to move a first end of the ramp assembly with respect to a deck of the vessel and to provide a second end of the ramp assembly at an appropriate position where the individual may use the ramp assembly for the ingress and egress with respect to the vessel; and wherein the positioning system is configured to:

apply a plurality of opposing first forces at different moments in time to the ramp assembly to move the first end of the ramp assembly between different elevational positions with respect to the deck of the vessel; and apply a plurality of opposing second forces to the ramp assembly to provide the second end of the ramp assembly at different elevational positions at different moments in time, and wherein the different elevational positions of the second end of the ramp assembly include the appropriate position where the individual may use the ramp assembly for the ingress and egress with respect to the vessel.

14. A vessel ramp assembly system comprising:

a ramp assembly configured to assist with ingress and egress of an individual with respect to a vessel;

a deployment system coupled with the ramp assembly and configured to move the ramp assembly between a stowed position with respect to the vessel and a deployed position with respect to the vessel;

a positioning system coupled with the ramp assembly and configured to move a first end of the ramp assembly with respect to a deck of the vessel and to provide a second end of the ramp assembly at an appropriate position where the individual may use the ramp assembly for the ingress and egress with respect to the vessel; and wherein the positioning system is configured to:

apply a plurality of opposing first forces at different moments in time to the ramp assembly to move the first end of the ramp assembly between different elevational positions which are elevationally above an elevation of the first end of the ramp assembly in the stowed position; and apply a plurality of opposing second forces to the ramp assembly at different moments in time to provide the second end of the ramp assembly at different elevational positions which are elevationally above and below an elevation of the second end of the ramp assembly in the stowed position, and wherein the different elevational positions of the second end of the ramp assembly include the appropriate position where the individual may use the ramp assembly for the ingress and egress with respect to the vessel.

15. A vessel ramp assembly system comprising:

a ramp assembly configured to assist with ingress and egress of an individual with respect to a vessel;

a deployment system coupled with the ramp assembly and configured to move the ramp assembly between a stowed position with respect to the vessel and a deployed position with respect to the vessel;

a positioning system coupled with the ramp assembly and configured to move a first end of the ramp assembly with respect to a deck of the vessel and to provide a second end of the ramp assembly at an appropriate position where the individual may use the ramp assembly for the ingress and egress with respect to the vessel;

a support assembly configured to be attached to a vessel; and wherein the deployment system includes a trolley assembly coupled with the ramp assembly, and wherein the trolley assembly is movably coupled with the support assembly to move the ramp assembly between the stowed and deployed positions and configured to support an entirety of the weight of the ramp assembly during movement of the ramp assembly between the stowed and deployed positions.

16. A vessel ramp assembly system comprising:

a support assembly configured to be attached to a vessel;

a ramp assembly configured to assist with ingress and egress of an individual with respect to the vessel;

a trolley assembly coupled with the ramp assembly and the support assembly, and wherein the trolley assembly is moveable between a first position relative to the support assembly where the ramp assembly is stowed with respect to the vessel and a second position relative to the support assembly where the ramp assembly is deployed with respect to the vessel;

wherein the trolley assembly includes a level lift assembly coupled with the ramp assembly, wherein the level lift assembly is configured to move a first end of the ramp assembly relative to a deck of the vessel when the ramp assembly is deployed;

wherein the trolley assembly includes a ramp lift assembly coupled with the ramp assembly, wherein the ramp lift assembly is configured to move a second end of the ramp assembly upwards or downwards when the ramp assembly is deployed to provide the second end of the ramp assembly at an appropriate position where the individual may use the ramp assembly for the ingress and egress with respect to the vessel; and wherein the level lift assembly is configured to apply a first force to move the first end of the ramp assembly upwards and downwards relative to the deck of the vessel when the ramp assembly is deployed and the ramp lift assembly is configured to apply a second force to move the second end of the ramp assembly upwards or downwards when the ramp assembly is deployed.

17. The system of claim 16 wherein the level lift assembly comprises a first actuator configured to apply the first force and the ramp lift assembly comprises a second actuator configured to apply the second force.

18. A vessel ramp assembly system comprising:

a support assembly configured to be attached to a vessel;

a ramp assembly configured to assist with ingress and egress of an individual with respect to the vessel;

a trolley assembly coupled with the ramp assembly and the support assembly, and wherein the trolley assembly is moveable between a first position relative to the support assembly where the ramp assembly is stowed with respect to the vessel and a second position relative to the support assembly where the ramp assembly is deployed with respect to the vessel;

wherein the trolley assembly includes a level lift assembly coupled with the ramp assembly, wherein the level lift assembly is configured to move a first end of the ramp assembly relative to a deck of the vessel when the ramp assembly is deployed;

wherein the trolley assembly includes a ramp lift assembly coupled with the ramp assembly, wherein the ramp lift assembly is configured to move a second end of the ramp assembly upwards or downwards when the ramp assembly is deployed to provide the second end of the ramp assembly at an appropriate position where the individual may use the ramp assembly for the ingress and egress with respect to the vessel; and wherein the trolley assembly is configured to support an entirety of the weight of the ramp assembly during movement of the ramp assembly between the first and second positions.

* * * * *